US005183109A

United States Patent [19]

Poulsen

[11] Patent Number: 5,183,109

[45] Date of Patent: Feb. 2, 1993

[54] METHOD FOR OPTIMIZING HYDRAULIC FRACTURE TREATMENT OF SUBSURFACE FORMATIONS

[75] Inventor: Don K. Poulsen, Duncan, Okla.

[73] Assignee: Halliburton Company, Duncan, Okla.

[21] Appl. No.: 781,523

[22] Filed: Oct. 18, 1991

[51] Int. Cl.[5] ..... E21B 43/267; E21B 47/06

[52] U.S. Cl. ..... 166/250; 73/155; 166/308

[58] Field of Search ..... 166/53, 66, 250, 280, 166/309; 73/155

[56] References Cited

U.S. PATENT DOCUMENTS

| | | | |
|---|---|---|---|
| 3,896,877 | 7/1975 | Vogt, Jr. et al. | 166/250 |
| 4,660,415 | 4/1987 | Bouteca | 73/155 |
| 4,724,434 | 2/1988 | Hanson et al. | 166/66 X |
| 5,050,674 | 9/1991 | Soliman et al. | 73/155 X |
| 5,070,457 | 12/1991 | Poulsen | 166/250 X |
| 5,105,659 | 4/1992 | Ayoub | 73/155 |

OTHER PUBLICATIONS

Interpretation of Fracturing Pressures by Kenneth G. Nolte, SPE, Amoco Production Company and Michael B. Smith, SPE, Amoco Production Company, Journal of Petroleum Technology, Sep. 1981, pp. 1767–1775.

*Primary Examiner*—George A. Suchfield
*Attorney, Agent, or Firm*—Robert A. Kent

[57] ABSTRACT

A method of optimizing a fracture treatment of a hydrocarbon-bearing subsurface formation based upon the logarithmic relationship of net fluid pressure and injected fluid volume data gathered during the fracture treatment.

20 Claims, 6 Drawing Sheets

METHOD FOR OPTIMIZING HYDRAULIC FRACTURE TREATMENT OF SUBSURFACE FORMATIONS

BACKGROUND OF THE INVENTION

1. Field of the Invention

The present invention relates generally to an improved method for optimizing a hydraulic fracture treatment of a subsurface formation, and more specifically relates to an improved method for determining the characteristics of the fracture in real time from fracturing fluid pressure and volume data, and optimizing the fracture treatment based on those determined characteristics.

2. Description of the Related Art

It is common in the industry to stimulate hydrocarbon bearing subsurface formations through hydraulic fracture operations. Typically, a fracture treatment consists of blending special chemicals to create an appropriate fracturing fluid and then pumping the fracturing fluid into the hydrocarbon bearing formation at a high enough rate and volume to cause the hydrocarbon bearing formation to fracture. Often times the fracture treatment consists of two different fluids used one after the other. The second fluid typically contains a propping agent, or proppant, which functions to prop open the fracture.

Hydraulic fracturing has evolved from the simple, low volume, low-rate treatments of the early 1950's into the complex procedures currently used. Today, hydraulic fracturing is the most widely used process for stimulating production from oil and gas wells.

The goal of a fracture treatment is to produce a subsurface fracture in a hydrocarbon bearing formation that is propped open with the right amount of proppant in the right locations. Fracture shape affects the production rate of the well and the production life of the well. The importance of early detection of deviations from the ideal fracture shape, or other deleterious occurrences such as, for example, screen out, vertical extension, or out of zone fracture, is well known in the art in order to improve or optimize the fracture treatment.

Recent advances in early detection of these conditions during fracturing treatments can be traced to advances in the interpretation of downhole fracturing pressures during fluid injection. These advances in interpretation have provided methods for controlling undesirable vertical fracture growth, improving fracture conductivity, and reducing formation damage.

An advance in the interpretation of downhole fracturing pressures was made by Nolte and Smith who found that fracture extension rates, critical net fracturing pressures, and vertical growth behavior can be inferred from downhole fracturing pressures. Nolte and Smith, *Interpretation of Fracturing Pressures,* JPT 1767–75 (Sep. 1981). Others in the hydraulic fracturing art have suggested that various types of fracture behavior can be identified from downhole fracture pressure information. Basically, these prior art techniques have compared the downhole fracturing pressure against fluid injection time on a logarithmic basis.

Various guidelines have been presented by those skilled in the art for interpreting the logarithmic behavior of fracturing pressure and injection time. One assumption implicit in most, if not all, of the interpretive guidelines is that the fluid injection rate is constant. However, injection rates are never really constant. For example, fluid injection rate does not instantaneously reach the desired value when pumping starts, but increases continuously from zero to the desired rate.

Rate variations may also occur as equipment is brought off and on line during the course of a treatment. And even when the rate is held arguably constant, mechanically induced variations in the injection rate still exist. The overall effect of this non-constant rate of injection is to lessen the accuracy and reliability of these prior art techniques.

Thus, it has long been desired to develop a method and/or apparatus for optimizing fracture treatment programs that accurately and reliably characterize the actual fracture regardless of variations in fluid injection rate.

The present invention answers this need by providing an improved method for characterizing the actual parameters of the hydraulically induced subsurface fracture from fracturing fluid pressure and volume data, and optimizing the remainder of the fracture treatment, or a subsequent fracture treatment, based on the fracture parameters.

SUMMARY OF THE INVENTION

A method is provided for optimizing the parameters of a fracturing treatment of a hydrocarbon-bearing subterranean formation which comprises the steps of injecting a volume of fluid into a wellbore that penetrates the subterranean formation at such rates and volumes that will generate a fracture in the formation. The pressure of the fluid in the wellbore over time is measured, preferably the pressure adjacent the wellbore, and the net pressure of the fluid in the wellbore over time is calculated. The volume of fluid injected into the wellbore over time is determined and the slope of the logarithmic relationship between the net pressure of the fluid in the wellbore and the injected volume is determined. This determination can be accomplished by a suitably programmed a real-time computer. The slope of the logarithmic relationship is compared against predetermined interpretive guidelines which are based upon a specific fracture model. The fracture treatment in progress or a subsequent fracture treatment is then modified based upon slope of the logarithmic relationship and the interpretive guidelines.

DETAILED DESCRIPTION OF A PREFERRED EMBODIMENT

The present invention is a new and improved method of optimizing hydraulic fracture treatments of subsurface formations. In its simplest form, the invention involves a new and improved method of accurately determining the characteristics of a hydraulically induced fracture during the fracture treatment and optimizing the remainder of the fracture treatment, or a subsequent fracture treatment, based on those determined characteristics.

In order to more fully appreciate the present invention, reference will be made throughout this disclosure to two example fracture treatments which demonstrate the preferred embodiment of the present invention and demonstrate the advantages of the present invention over the prior art.

The first fracture treatment example is MiniFrac No. 2 of GRI's Staged Field Experiment No. 3 (SFE3). *Staged Field Experiment No. 3: Application of Advanced Technologies in Tight Gas Sandstones—Travis Peak and Cotton Valley Formation, Waskom Field, Harrison County, Texas Reservoirs,* Report No. GRI-910048 (Feb. 1991). Downhole pressure data were obtained through a 9001 ft. dead string containing fluid of specific gravity 1.077 with hydrostatic pressure calculated to a depth to top of perforations of 9225 ft. Perforation frictions, determined by comparing surface pressures immediately before and after sudden changes in rate (e.g., shut-ins), gave an average perforation discharge coefficient of 0.685 for the seventy-two 0.330 in. perforations. A reported closure pressure ($\sigma_{min}$) value of 5250 psi was used.

Figure 1:
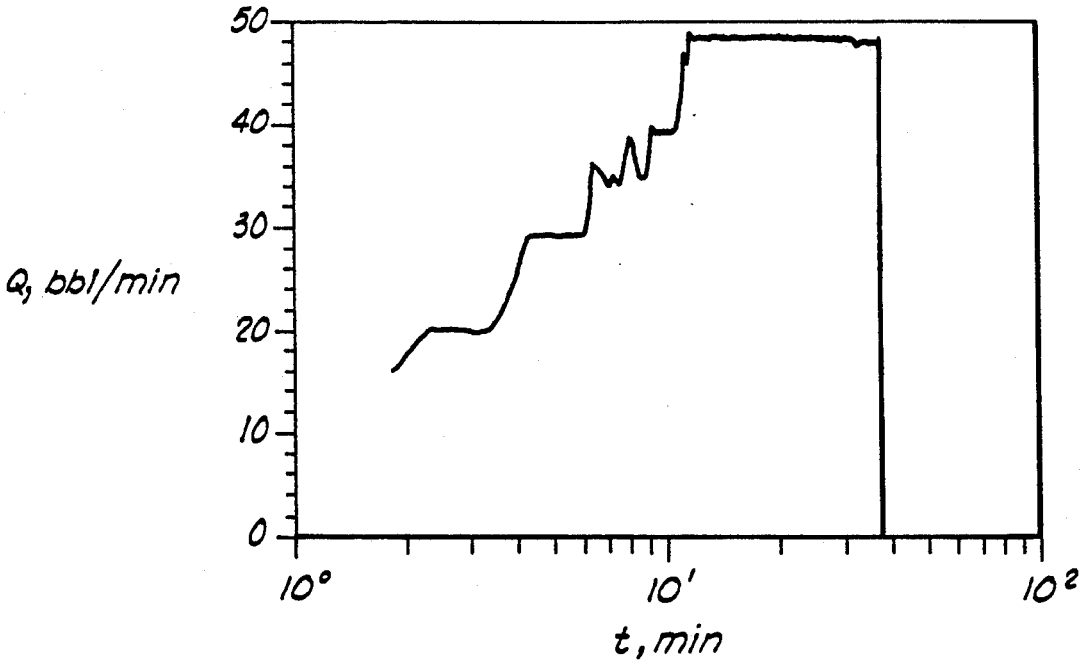
FIG. 1 shows fluid injection rate versus fluid injection time for the SFE3 Minifrac example fracture treatment.

As shown in FIG. 1, total fluid injection into the fracture lasted approximately 37½ min. The injection rate followed a somewhat erratic upward trend for about the first 11½ min of the treatment until stabilizing at approximately 48.4 bbl/min. The treatment was performed with a 40 lb/1000 gal linear CMHPG gel with a reported n value of 0.56.

Figure 2:
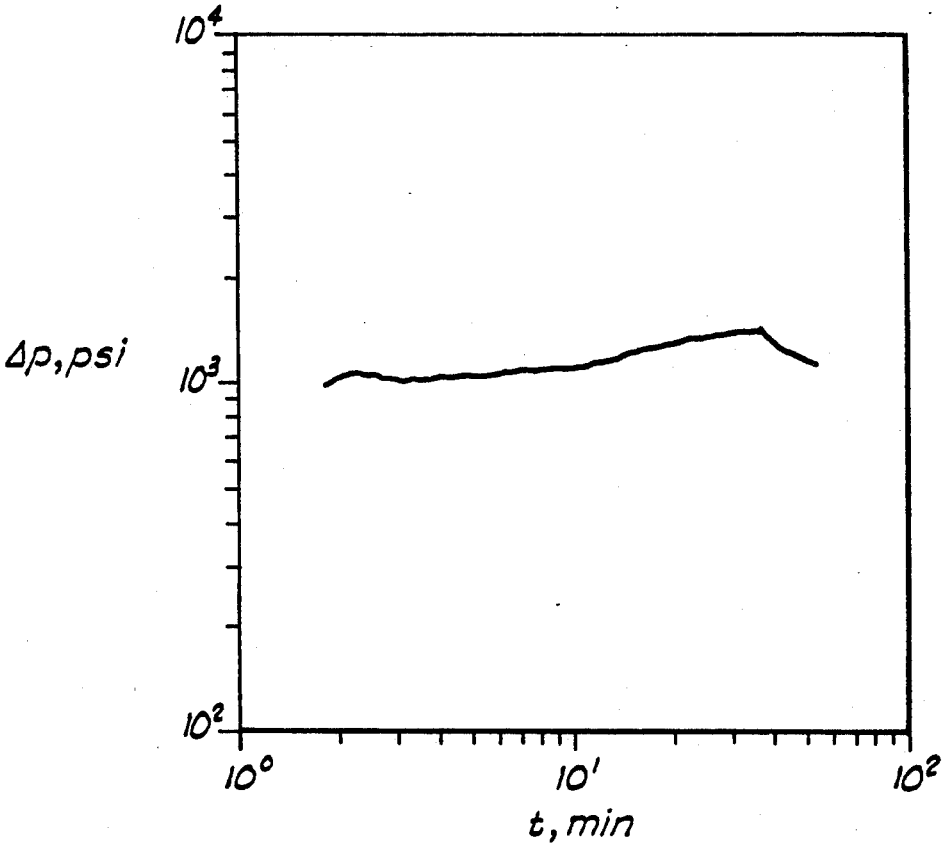
FIG. 2 shows the logarithmic behavior of net pressure and fluid injection time for the SFE3 Minifrac example fracture treatment.

FIG. 2 illustrates the prior art method of determining characteristics of the fracture by interpreting the logarithmic behavior of net pressure, Δp, and injection time, t. Net pressure is defined as the pressure adjacent to the wellbore minus the closure pressure of the fracture. As discussed previously, this prior art method is based on the assumption that the injection rate is constant. FIG. 1 clearly shows the erratic and non-constant rate of injection of this fracture treatment. The prior art method illustrated in FIG. 2 cannot account for this non-constant rate of injection. The interpretive guidelines associated with this type of prior art method, which are well-known to those skilled in the art, cannot provide an accurate assessment of what is happening at the fracture during a treatment, thus hampering efforts to optimize the fracture treatment.

The present invention, which is based on the logarithmic behavior of net pressure, (Δp) and volume, V, overcomes this limitation of the prior art methods. As will be described more fully below, it has been found that changes in the wellbore pressure are less sensitive to variations in injection rate when compared against injected volume instead of against injection time. This allows the present invention to achieve a greater degree of certainty over the actual fracture characteristics, thereby increasing the opportunity for optimizing the fracture treatment.

In order to fully appreciate the present invention, the theoretical basis for its applicability will be discussed. Various fracture models are known to those skilled in the hydraulic fracture art. For constant height fracture models such as those based on the Khristianovic and Zheltov ("KZ") or Sneddon ("PK") width equations, the volume of the fracture is simply the product of the total length, the height, and the average width. For a radial fracture, the volume of fracture is proportional to the square of the radius times the width.

$$V_f = \begin{bmatrix} 2LH \\ 2LH \\ \pi R^2 \end{bmatrix} W \begin{matrix} (KZ\text{-type}) \\ (PK\text{-type}) \\ (\text{radial}) \end{matrix} \tag{1}$$

where $V_f$=fracture volume;

L=fracture half length;

H=fracture height;

R=fracture radius; and $\overline{W}$=average fracture width

From the geometry of the fracture, a proportionality constant between the maximum width of the fracture at the wellbore and the average fracture width can be found for each of the models.

$$W = \begin{bmatrix} \frac{\pi}{4} \\ \frac{\pi}{4}\left(\frac{2n+2}{2n+3}\right) \\ \frac{2}{3} \end{bmatrix} W_{max} \tag{2}$$

where, n=power-law flow behavior index; and $W_{max}$=maximum fracture width.

Substituting Eq. 2 into Eq. 1 gives the relationships between fracture volume and maximum fracture width for the three fracture models:

$$V_f = \begin{bmatrix} \frac{\pi}{2} HL \\ \pi\left(\frac{n+1}{2n+3}\right)HL \\ \frac{2\pi}{3} R^2 \end{bmatrix} W_{max} \quad (3)$$

The fracture width equations for the various models are known in the art.

$$W_{max} = \frac{2\Delta p}{E'} \begin{bmatrix} 2L \\ H \\ \frac{4}{\pi} R \end{bmatrix} \quad (4)$$

where $\Delta p$=net fracturing pressure=$p_w - \Delta_{min}$;

$p_w$=pressure adjacent to the wellbore;

$\sigma_{min}$=least principle stress;

$E'$=plane strain modulus=$E/(1-\mu^2)$;

E=Young's modulus; and $\mu$=Poisson's ratio

Solving the fracture width equations (4) for $\Delta p$:

$$\Delta p = \frac{E'}{2} W_{max} \begin{bmatrix} \frac{1}{2L} \\ \frac{1}{H} \\ \frac{\pi}{4R} \end{bmatrix} . \quad (5)$$

Solving Eq. 3 for $W_{max}$ and substituting the result into Eq. 5 shows that $$\Delta p = \frac{E'}{2\pi} \begin{bmatrix} \frac{1}{HL^2} \\ \left(\frac{2n+3}{n+1}\right)\frac{1}{H^2L} \\ \frac{3}{8R^3} \end{bmatrix} V_f \quad (6)$$

From Eq. 6, those skilled in the art having benefit of this disclosure can see that for fracture length or radius to remain constant (e.g., restricted extension), which may be indicative of proppant bridging, the net pressure must remain in proportion to fracture volume (assuming, of course, that fracture height is unchanging for the KZ and PK models). In other words, the logarithmic behavior of $\Delta p$ and $V_f$ should exhibit a slope of 1 for conditions of restricted extension.

Interestingly, even though the present invention is based on a wholly different analytically technique than the prior art methods, the interpretive guidelines associated with the prior art methods are still applicable to the present invention. This can be shown as follows:

$$\eta = \frac{V_f}{V_i} \quad (7)$$

where $\eta$=fluid efficiency; and $V_i$=slurry volume injected, and, for a constant injection rate, $$V_i = Qt \quad (8)$$

where

Q =injection rate; and t=injection time.

Thus, those skilled in the art having the benefit of this disclosure will appreciate that the interpretation of the logarithmic behavior of $\Delta p$ and $V_f$ with a slope of 1 is the same as that for a slope of 1 on the prior art log($\Delta p$)-log(t) graph (FIG. 2) generated under the condition of constant rate of increase in fracture volume, $Q\eta$. In other words, for constant rate injection, the logarithmic behavior of net pressure, $\Delta p$, versus reduced time, $\eta t$, is comparable to the logarithmic behavior of net pressure, $\Delta p$, versus $V_f$.

In addition to being less dependent on injection rate than the prior art methods, the logarithmic behavior of $V_f$ is such that, to a large extent, it is also independent of fluid efficiency. This property of the present invention makes it applicable to shut-in and flowback conditions as well as during injection.

Unfortunately, however, it is extremely difficult, if not impossible, to determine the actual fracture volume, $V_f$, and thus fluid efficiency, with any degree of accuracy. According to the present invention, however, the logarithmic behavior of $V_i$ can be utilized instead of the logarithmic behavior of $V_f$.

Assuming that fluid efficiency is nearly constant the prior art interpretive guidelines remain valid when analyzing the logarithmic behavior of net pressure, $\Delta p$, and injected volume, $V_i$. The assumption that fluid efficiency is nearly constant is not an unreasonable assumption. When there is no fluid loss the efficiency is identically 1. For high fluid loss, constant injection rate, and normal fracture growth $$\eta \alpha \begin{bmatrix} t^{-\frac{n}{2(n+1)}} \\ t^{-\frac{1+2n}{4(n+1)}} \\ t^{-\frac{2+5n}{8(n+1)}} \end{bmatrix} \quad (9)$$

Equation 10 shows that for a Newtonian fluid (i.e., n=1), $$\eta_{n=1} \alpha \begin{bmatrix} t^{-\frac{1}{4}} \\ t^{-\frac{3}{8}} \\ t^{-\frac{7}{16}} \end{bmatrix} \quad (10)$$

and for the lower bound on the flow behavior index (n=0), $$\eta_{n=0} \alpha \begin{bmatrix} t^{0} \\ t^{-\frac{1}{4}} \\ t^{-\frac{1}{4}} \end{bmatrix} \quad (11)$$

demonstrating that, in most instances, fluid efficiency is not a strong function of time.

Those skilled in the art will appreciate one instance in which analyzing the logarithmic behavior of injected volume does not provide the information that the logarithmic behavior of fracture volume does is during a period when the fracture is shut in. By definition, $V_i$ does not change when a well is shut in, but the volume that has leaked-off, and thus the fluid efficiency continues to change, invalidating the assumption of near proportionality between injected and fracture volume. More simply put, because $V_i$ is not changing during a shut-in period but $\Delta p$ is, a $\Delta p$ versus $V_i$ plot will display a vertical line and a $-\infty$ value will be calculated for the slope.

Figure 3:
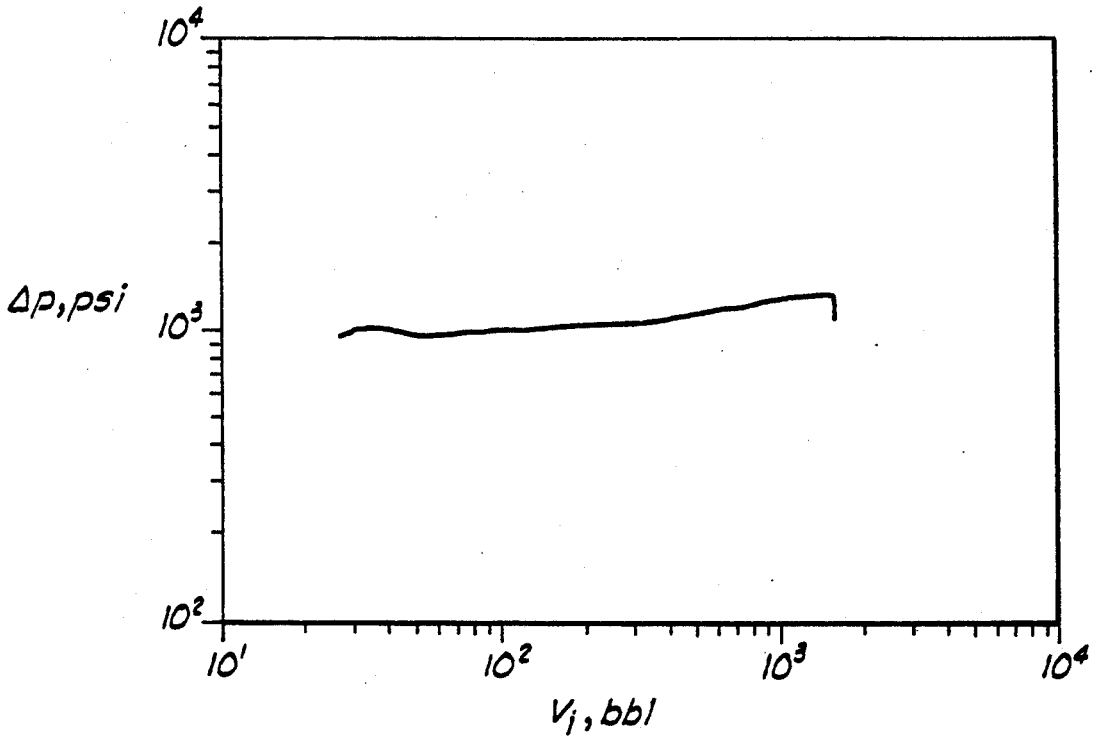
FIG. 3 shows the logarithmic behavior of net pressure and injected fluid volume for the SFE3 Minifrac example fracture treatment.

Referring now to FIG. 3, an aspect of the present invention is illustrated in the form of a logarithmic plot of net pressure, $\Delta p$, and injected volume, $V_i$, for the data of the first example fracture treatment (SFE3 Minifrac). Those skilled in the art having benefit of this disclosure will see from FIG. 2, 3 and Table 1 that the slopes on the injected volume plot (FIG. 3) are somewhat more shallow than those on the time plot (FIG. 2).

TABLE 1

| Time Interval (min) | Linear Regression Results For SFE3 Example: Average Slope | | Coefficient Of Determination | |
|---|---|---|---|---|
| | $\Delta p$ vs $V_i$ | $\Delta p$ vs t | $\Delta p$ vs $V_i$ | $\Delta p$ vs t |
| 3.1–11.5 | 0.054 | 0.080 | 0.9699 | 0.9696 |
| 11.5–37.4 | 0.146 | 0.187 | 0.9898 | 0.9792 |

Utilizing the interpretive guidelines known to those skilled in the art, the present invention allows the various fracture treatment parameters to be modified or optimized in response to information about the fracture gleaned from the logarithmic behavior of net pressure and injected volume.

Any of the valid guidelines for interpreting fracture behavior based on injection time at constant injection rate can be shown to be acceptable for interpreting fracture behavior based on injected volumes. These include, but are not limited to, guidelines for creation of multiple parallel fractures, intersection with natural fractures, and intersection with bounding faults.

In a preferred embodiment of the present invention, a computer-based data acquisition system acquires wellbore pressure data which is preferably bottom hole pressure, but can be surface pressure or some other wellbore pressure that can be equated to the wellbore pressure adjacent to the fracture. The data acquisition system also acquires data from which the volume of injected fracturing fluid can be obtained, either directly or indirectly. Typically, the data acquisition system will also acquire data on other fracture treatment parameters, such as, for example, elapsed time, or temperature.

A programmable, real-time computer, which can be the data acquisition computer, is suitably programmed to analyze the logarithmic behavior of net pressure, $\Delta p$, and injected volume, $V_i$, according to conventional interpretive guidelines known to those skilled in the art. For example, the real-time computer can be programmed to signal the fracture treatment operator when the logarithmic behavior of net pressure and injected volume exhibits a slope of 1 which, according to the conventional interpretive guidelines may indicate restricted fracture extension or proppant bridging.

As described, the real-time computer can be programmed to produce an output, signal or alarm to indicate to the fracture treatment operator the occurrence of some preprogrammed fracture occurrence. The fracture treatment operator can then modify or optimize the remaining fracture treatment based on the output, signal or alarm. In addition, the real-time computer can be programmed to automatically modify or optimize the fracture treatment without disturbing the operator. For example, the real-time computer can be programmed to ensure a constant injection rate by suitable control circuitry with the pumping equipment, or can shut down the fluid injection equipment.

Thus, the present invention allows a fracture treatment operator to modify or optimize an ongoing fracture treatment in response to better information regarding the actual characteristics of the fracture.

Returning now to a discussion of the theoretical basis for the present invention, those skilled in the art will appreciate from Eq. 6 that for fracture length or radius to decrease as fracture volume increases (i.e., for length to be a monotonically decreasing function of $V_f$), either the $\log(\Delta p)$-$\log(V_f)$ slope must be greater than 1 or the fracture height must increase. This reveals that a slope greater than 1 on such a plot may indicate that the fracture length is decreasing. But because the subsurface formation cannot heal, this may be best described as an effective decrease in fracture length or radius, caused most likely by proppant packing off the fracture increasingly nearer to the wellbore.

Figure 4:
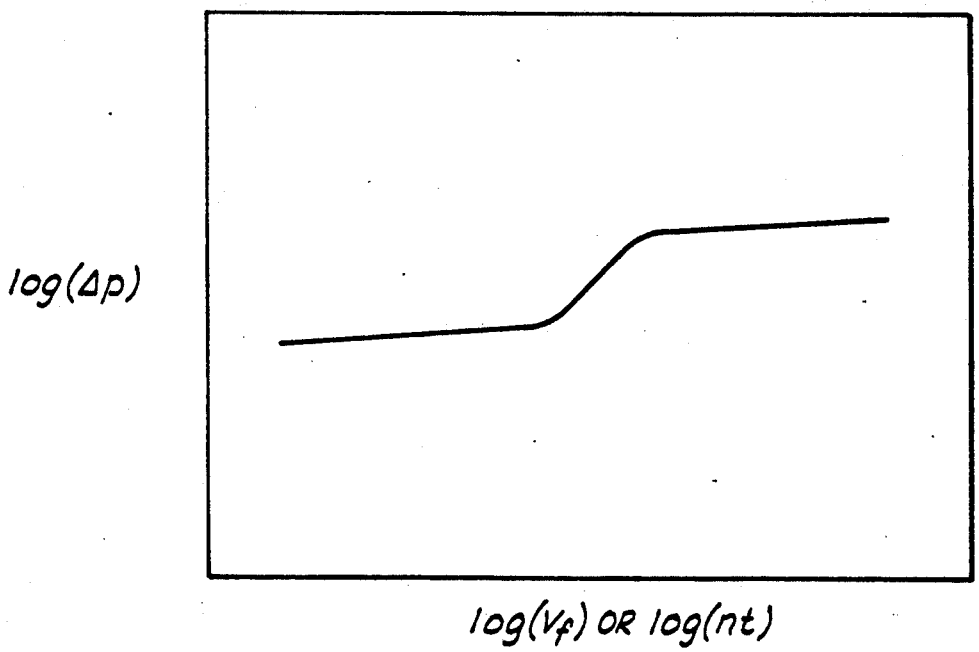
FIG. 4 shows the logarithmic behavior of net pressure for arrested fracture growth.

Those skilled in the art will appreciate that complete blockage of flow into one fracture wing would result in a doubling of flow into the remaining wing, assuming injection rate remained constant. The doubled rate into the single wing would result in a correspondingly higher pressure, such as would be seen if the injection rate into two unrestricted wings had been doubled. This would result in an increase in slope on a cartesian plot of $\Delta p$ versus $V_f$, but on a log-log graph the curve would simply exhibit a vertical shift similar to that shown in FIG. 4. In other words, the slope of a $\log(\Delta p)$-$\log(V_f)$ plot and even those on $\log(\Delta p)$-$\log(\eta t)$ plots are independent of the value of rate of injection for well-confined and radial fractures when that rate is constant. This is in contravention to the prior art interpretation that blockage of flow into one of the fracture wings (presumably with growth of the other wing restricted) would result in a log-log slope of 2. As illustrated in FIG. 4, under most circumstances a flow restriction would not occur instantaneously, but would result from a gradual packing of the fracture.

As pointed out above, a slope greater than 1 could indicate a continuous, but possibly rapid, blocking process of one or both fracture wings. By substituting $\eta V_i$ for $V_f$ in Eq. 6, those skilled in the art will appreciate that after tip screenout has occurred, the increase in fluid efficiency resulting from having a constant or decreasing fracture area will result in an even larger slope on the logarithmic behavior of net pressure versus injected volume, assuming injection rate is constant, or at least not decreasing rapidly enough to counteract the decrease in fluid-loss rate.

To obtain further fracture treatment guidelines, Eq. 1 can be solved for length or radius and the result substituted into Eq. 6 to get $$\Delta p = \frac{E'}{\pi}\left[\begin{array}{c} \dfrac{2W^2H}{V_f} \\ \left(\dfrac{2n+3}{n+1}\right)\dfrac{W}{H} \\ \dfrac{3(\pi W)^{3/2}}{16V_f^{1/2}} \end{array}\right] \tag{12}$$

Eq. 12 shows that for fracture width to remain constant, $\Delta p$ must be inversely proportional to $V_f$ for KZ geometry, constant for PK geometry, and inversely proportional to the square root of $V_f$ for radial geometry. Stated in terms of slope, $\epsilon_v$, on a logarithmic plot of $\Delta p$ versus $V_f$, $$\epsilon_v = \left[\begin{array}{c} -1 \\ 0 \\ -\dfrac{1}{2} \end{array}\right] \tag{13}$$

where $\epsilon_v = \log(\Delta p)\text{-}\log(V_i)$ slope or $\log(\Delta p)\text{-}\log(V_f)$ slope Slopes lower than these would indicate that the fracture width is narrowing. This could be indicative of less restricted height growth resulting from penetration into a zone of lower least principle stress. It could also indicate fracture penetration, vertically or horizontally, into an area of higher fluid-loss rate.

It can be shown by the application of fluid mechanics to the fracture treatment, that, independently of fluid-loss rate $$\Delta p \alpha \left[\begin{array}{c} Q^{\frac{n}{n+2}} V_f^{-\frac{n}{n+2}} \\ Q^{\frac{n}{2n+3}} H^{-\frac{3n+3}{2n+3}} V_f^{\frac{1}{2n+3}} \\ Q^{\frac{n}{n+2}} V_f^{-\frac{n}{n+2}} \end{array}\right] \tag{14}$$

Relationships between net pressure and injected volume for minimal fluid-loss conditions may be obtained by substituting $V_i$ for $V_f$ in Eq. 14.

It can also be shown that under conditions of high fluid loss and constant injection rate, net pressure is related to the injected volume through $$\Delta p \alpha \left[\begin{array}{c} HV_i^{-\frac{n}{2(n+1)}} \\ Q^{\frac{3}{4(n+1)}} H^{-\frac{3n+2}{2(n+1)}} V_i^{\frac{1}{4(n+1)}} \\ Q^{\frac{n}{8(n+1)}} V_i^{-\frac{3n}{8(n+1)}} \end{array}\right] \tag{15}$$

Although Eqs. 14 and 15 are derived using certain assumptions about rate behavior, several interesting observations can be made from these equations. Eq. 14 shows that if logarithm of net pressure was plotted versus logarithm of fracture volume for a true constant height or radial fracture, the slope of the resulting curve would be largely independent of the amount of fluid loss. In addition, for KZ-type or radial fractures, the predicted slopes on this type of plot are identical.

Another observation is that the predicted slopes for a logarithmic plot of net pressure and injected volume are identical to those for a logarithmic plot of net pressure and time under conditions of constant rate o injection. The reason for this can be seen by substituting the product Qt for $V_i$ in Eqs. 14 and 15 to get the net pressure-time relationships.

And, although the behavior of data plotted on a $\log(\Delta p)\text{-}\log(V_i)$ graph is not completely independent of variations in injection rate (with the possible exception of KZ geometry at low efficiencies), it is affected significantly less by any such variations. This can be seen by the fact that substituting the product Qt for $V_i$ in Eqs. 14 and 15 modifies the power on Q. The slope on a logarithmic plot of $\Delta p$ and $V_i$ and that on a logarithmic plot of $\Delta p$ and t are related by $$\begin{aligned} \epsilon_t &= \frac{d[\log(\Delta p)]}{d[\log(t)]} \\ &= \frac{d[\log(\Delta p)]d[\log(V_i)]}{d[\log(V_i)]d[\log(t)]} \\ &= \epsilon_v \frac{t}{V_i}\frac{dV_i}{dt} \\ &= \epsilon_v = \frac{Qt}{V_i} \\ &= \epsilon_v \frac{Q(t)}{Q(t)} \end{aligned} \tag{16}$$

where $\epsilon_t = \log(\Delta p)\text{-}\log(t)$ slope

From this, those skilled in the art can see that if the instantaneous injection rate is greater than the average injection rate up to the point under consideration, then the slope on the time graph will be larger than that on the volume graph and vice versa. It also reveals the greater dependency of $\epsilon_t$ on the prior injection rate history.

As has been discussed above, the present invention allows the optimization of fracture treatments based upon the interpretation of the logarithmic behavior of net pressure and the logarithm behavior of injected volume, from which the slopes exhibited by the data provide the primary source interpretation.

An alternate embodiment of the invention involves analyzing the logarithmic behavior of the slope of the net pressure/injected volume relationship. The slope is calculated as $$\epsilon_v = \frac{d[\log(\Delta p)]}{d[\log(V_i)]} = \frac{V_i\, d\Delta p}{\Delta p\, dV_i} = \frac{V_i\, dp_w}{\Delta p\, dV_i} \tag{17}$$

Several numerical techniques known to those skilled in the art exist for calculating the derivative values and may be easily incorporated into the programmable real-time computer described above.

In this alternate embodiment of the present invention, slope is plotted on the ordinate axis and abscissa may be any of several variables; however, to allow direct comparison with the $\log(\Delta p)$ versus $\log(V_i)$ graph, plotting $\log(V_i)$ on the abscissa is the most practical choice. Analysis of $\log(\Delta p)\text{-}\log(t)$ slope versus $\log(t)$ is known to those skilled in the art.

As can be noted from Eqs. 14 and 15, the log-log slope varies with fluid efficiency; thus, at least theoretically, a relative indication of fluid efficiency may be obtained by plotting a normalized slope, $$\frac{\epsilon_v - \epsilon_o}{\epsilon_1 - \epsilon_o} \tag{18}$$

as the ordinate value, where $$\epsilon_o = \begin{bmatrix} -\frac{n}{2(n+1)} \\ \frac{1}{4(n+1)} \\ -\frac{3n}{8(n+1)} \end{bmatrix} \tag{19}$$

$$\epsilon_1 = \begin{bmatrix} -\frac{n}{n+2} \\ \frac{1}{2n+3} \\ -\frac{n}{n+2} \end{bmatrix} \tag{20}$$

If the fracture behaves as predicted by the assumed model, e.g., KZ, PK or radial, the normalized slope will have a value of 1 when the efficiency is 1 and a value of 0 when the efficiency is 0. It must be borne in mind however, that although the normalized slope and the fluid efficiency correspond at these two values, the relationship between slope and efficiency is not necessarily linear. An empirical relationship between these values has been developed for PK-type geometries and is known to those skilled in art. Of course, to use the normalized slope plot, one must assume that the fracture behaves according to a particular fracture growth model. One must also assume the value of the fluid's flow behavior index, n.

A more practical alternative to creating an actual "normalized slope" graph is to plot horizontal lines corresponding to the limits given in Eqs. 19 and 20 on the derivative plot. In doing so, the actual slope values are retained and comparisons to the behavior predicted by each of the models can be realized.

Recently, the technique of plotting $\log(t[dp_w/dt])$ against $\log(t)$ has been introduced into the art. Presumably, this graph will yield the same slope as the $\log(\Delta p)$ versus $\log(t)$ graph, but only when a power-law relationship holds between $\Delta p$ and t; i.e., when the $\log(\Delta p)$-$\log(t)$ slope is constant.

From Eq. 17, it can be seen that $$V_i \frac{dp_w}{dV_i} = \epsilon_v \Delta P \tag{21}$$

and thus, relationships between $V_i(dp_w/Dv_i)$ and $V_i$ may be obtained by multiplying both sides of those equations (6, 14, and 15) relating $\Delta p$ and $V_i$ by $\epsilon_v$. This implies that plots of $\log(V_i[dp_w/Dv_i])$ versus $\log(V_i)$ will be less sensitive to variations in injection rate than will the prior art plots recently introduced and therefore be applicable over a greater range of conditions.

A shortcoming of both of these alternate embodiments however, is that they cannot handle constant or decreasing pressure. A partial remedy is to plot pressure decreases on a graph having $\log(-V_i[dp_w/dV_i])$ on the ordinate. Unfortunately, since pressure increases and decreases commonly occur within the same treatment, this will require two graphs or two distinct curves on a graph with a $\log|V_i[dp_w/dV_i]$ ordinate scale.

Figure 5:
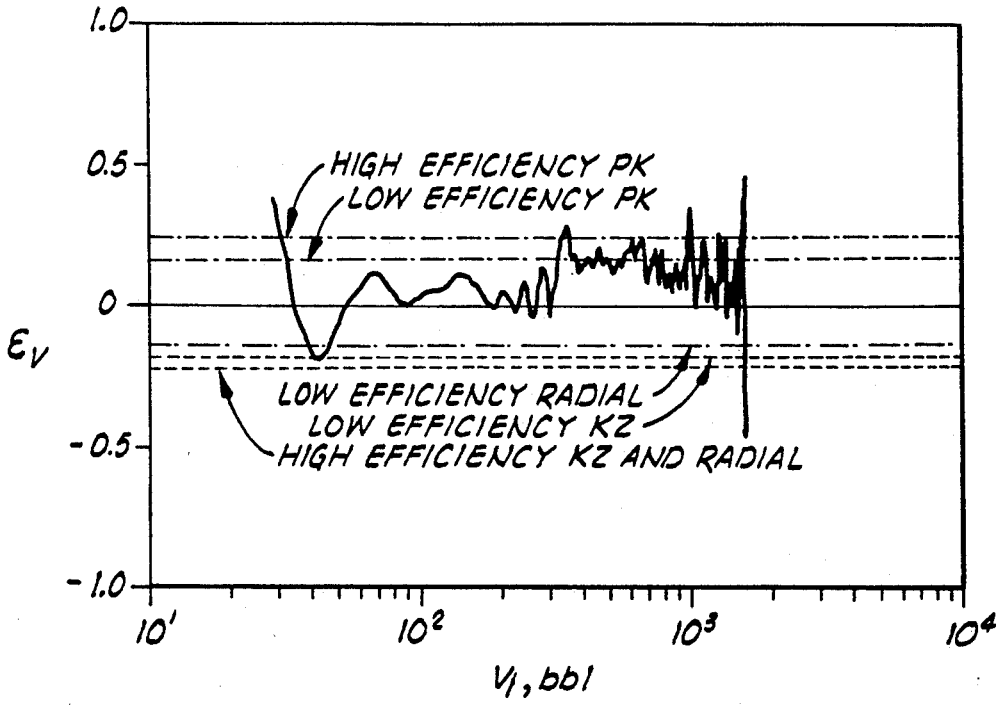
FIG. 5 shows the behavior of the slope of the log-log net pressure/injected volume relationship as compared against log injected volume for the SFE3 Minifrac example.
Figure 6:
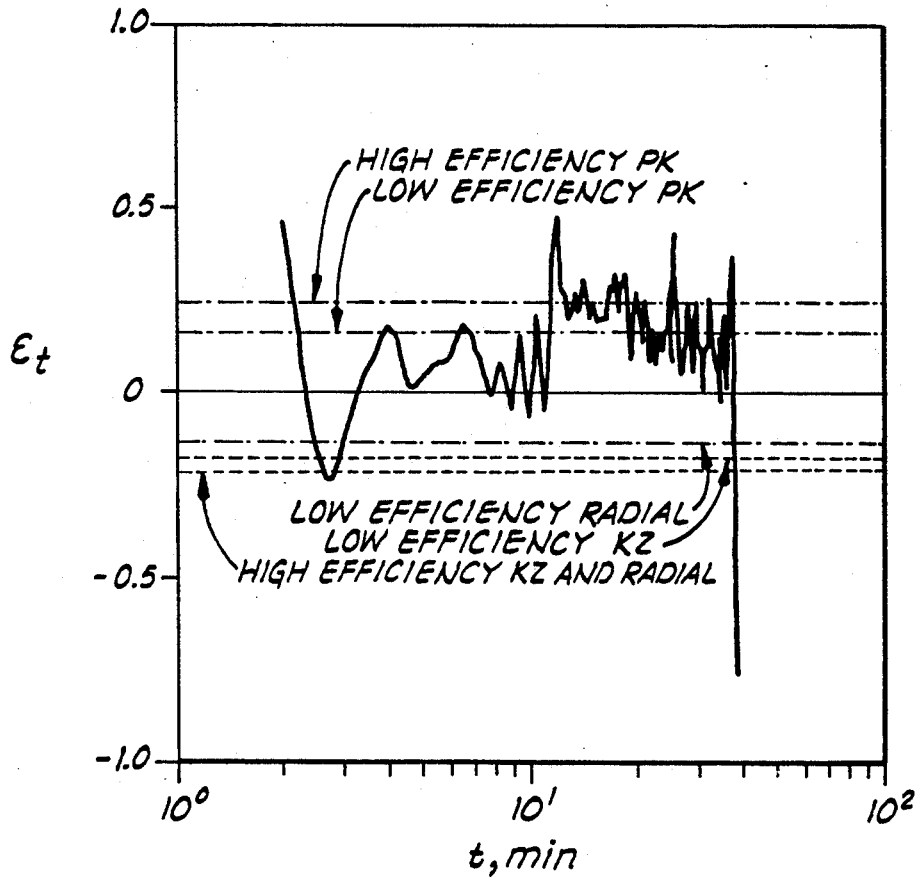
FIG. 6 shows the behavior of the slope of log-log net pressure/injection time relationship as compared against log injection time for the SFE3 Minifrac example.

Referring now to FIGS. 5 and 6, these Figures are the corresponding derivative plots for FIGS. 3 and 2, respectively. In addition to the derivative curves, these graphs contain horizontal lines indicating the maximum and minimum slopes predicted by each of the three fracture geometries (Eqs. 14 and 15). From the top down, these lines are (1) high efficiency PK geometry, (2) low efficiency PK geometry, (3) low efficiency radial geometry, (4) low efficiency KZ geometry, and (5) high efficiency KZ and radial geometries.

Examining the derivative curves and Table 1 shows that there is less variation in the slopes on the injected volume plot than on the time plot and that the slopes are, in most cases, noticeably shallower.

Noting the relationship of the curves to the slopes predicted by the three fracture models, they fall within the predicted ranges of any of the models for only brief durations. Although these lines were drawn using a given value of n, using a different n value might increase the amount of data falling within the range of a given model, but would still leave much of the data outside that range. This implies that actual fracture behavior falls, for the most part, outside that assumed in devising any of these models.

Figure 7:
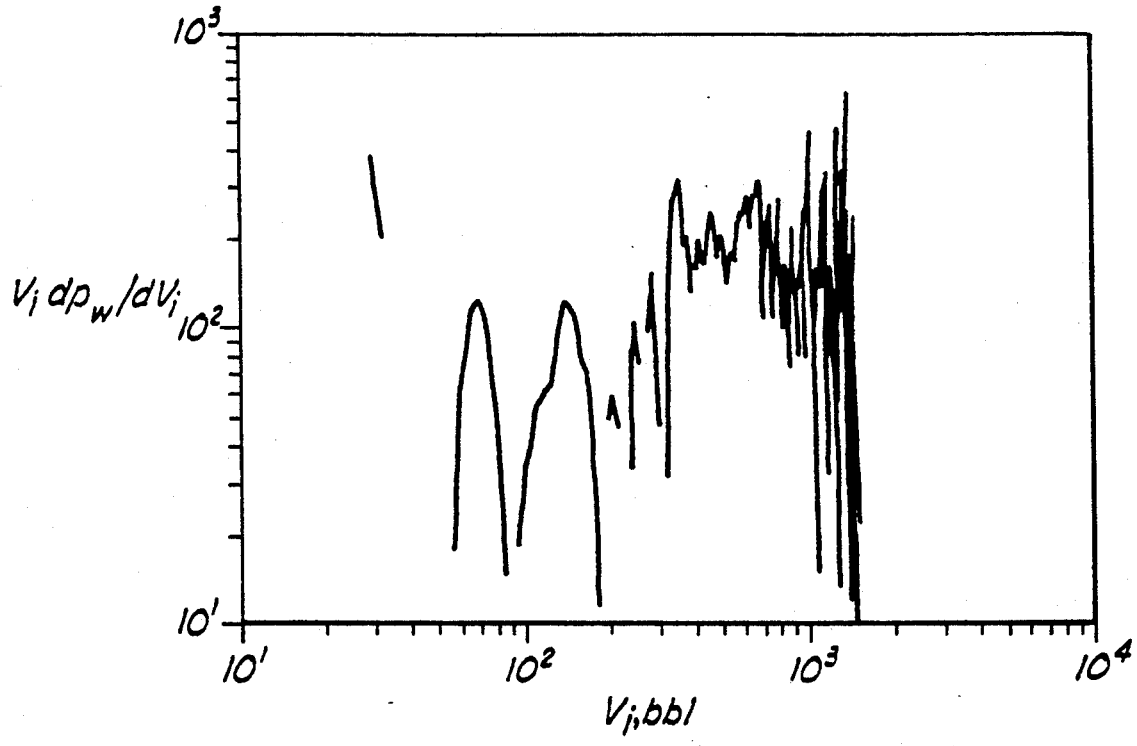
FIG. 7 shows the logarithmic behavior of $V_i[dp_w/dV_i]$ as compared against $V_i$ for the SFE3 Minifrac example.

FIG. 7 is a graph of $\log(V_i[dp_w/dV_i])$ versus $\log(V_i)$. This Figure illustrates that in an instance such as this, where for even short periods log-log slopes become very shallow or even negative, this type of graph may appear very erratic and be difficult to interpret. Its sensitivity to changes in slope also serves to illustrate the earlier point that the log-log slope must be very nearly constant for this type of graph to clearly show growth trends.

Figure 8:
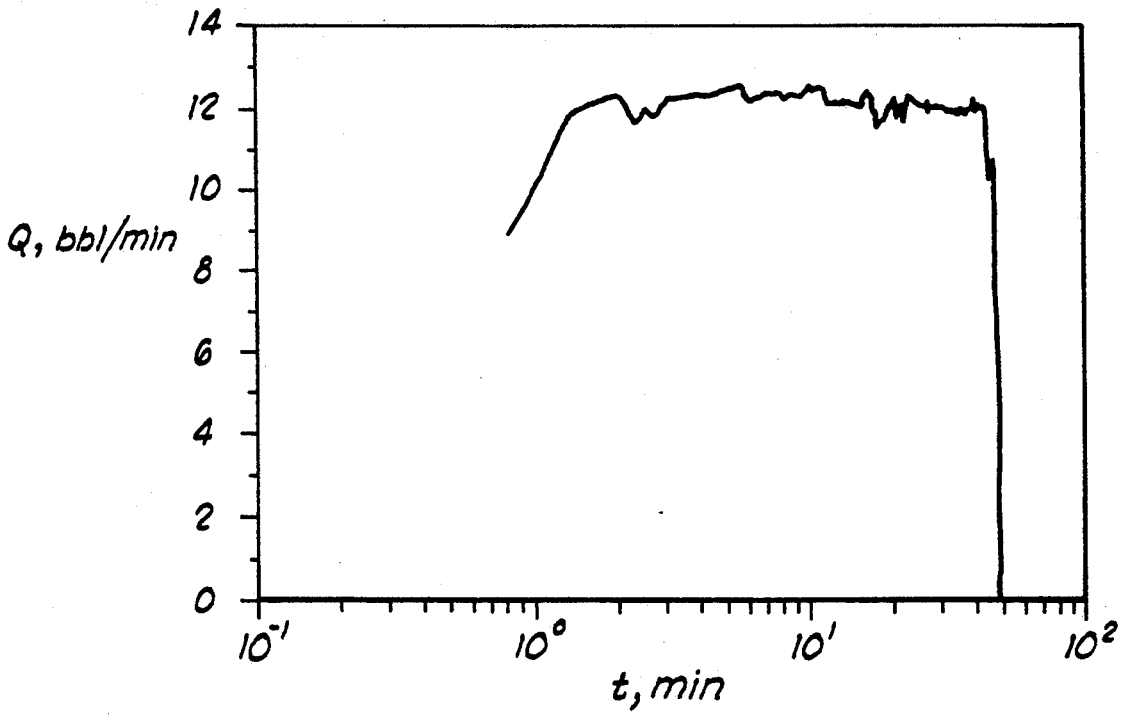
FIG. 8 shows fluid injection rate versus fluid injection time for the San Andres example fracture treatment.

The second example fracture treatment which demonstrates the present invention uses data from a fracturing treatment performed in the San Andres formation of west Texas. Pressure was measured through a live annulus. As can be seen in FIG. 8, excepting the very early portion of the job and subsequent minor fluctuations, the fluid injection rate was held near 12 bbl/min.

Figure 9:
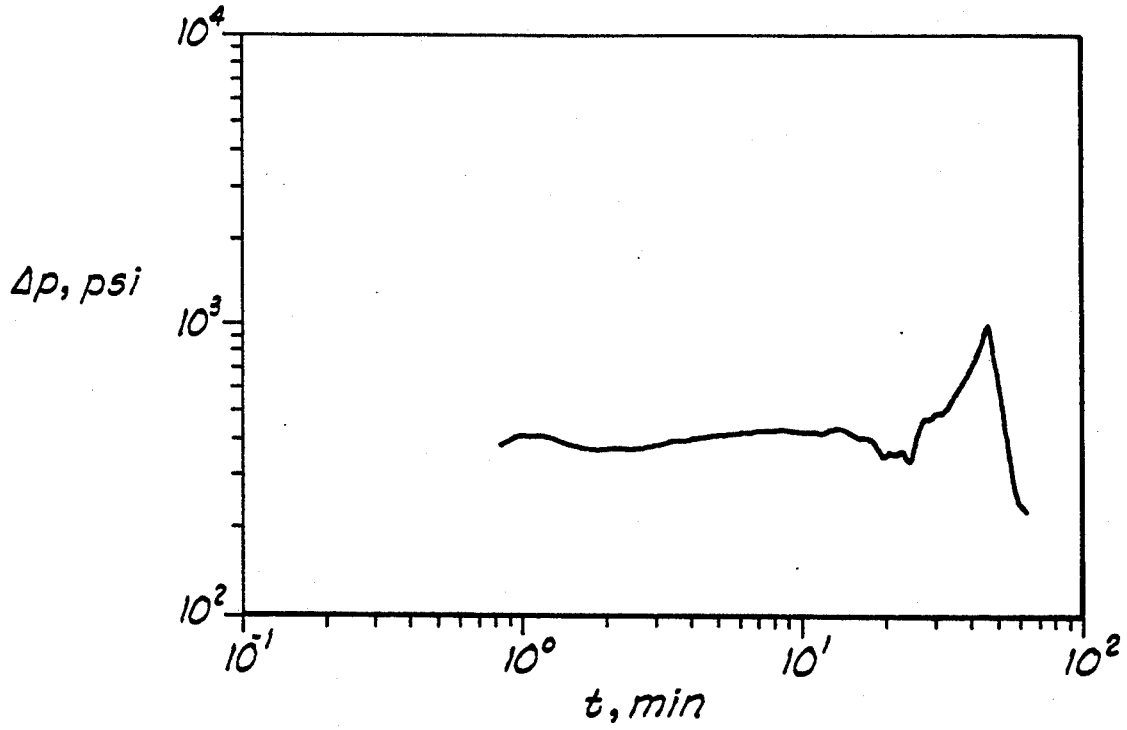
FIG. 9 shows the logarithmic behavior of net pressure and injection time for the San Andres fracture treatment example.
Figure 10:
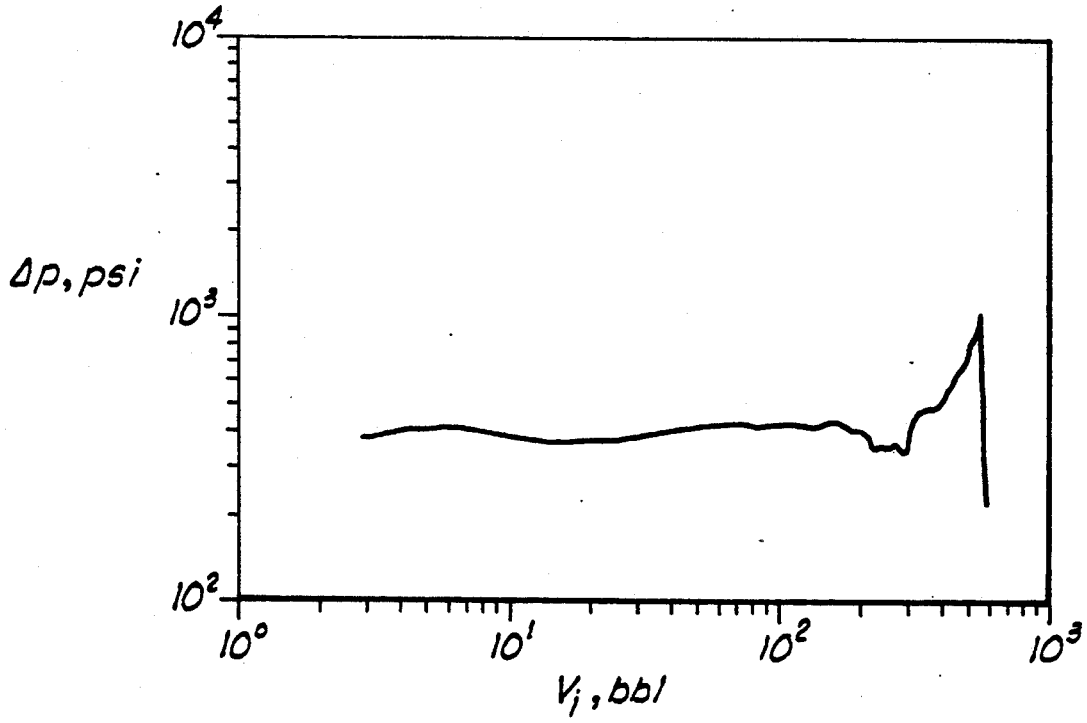
FIG. 10 shows the logarithmic behavior of net pressure and injected volume for the San Andres fracture treatment example.
Figure 11:
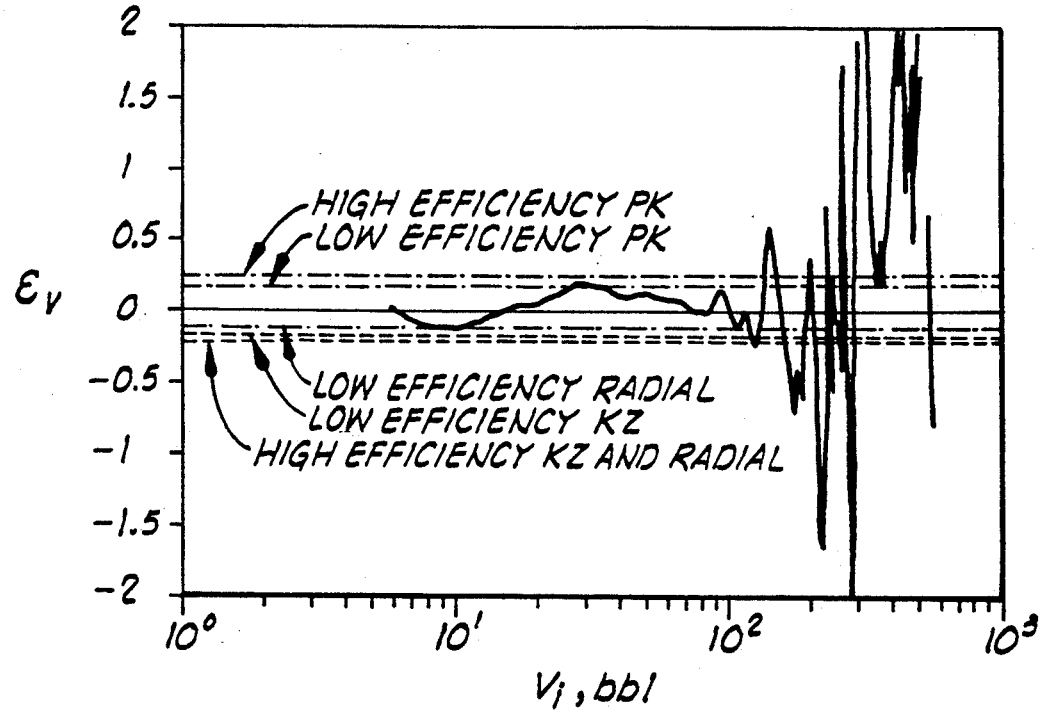
FIG. 11 shows the behavior of the slope of the log-log net pressure/injected volume relationship as compared against log injected volume for the San Andres fracture treatment example.
Figure 12:
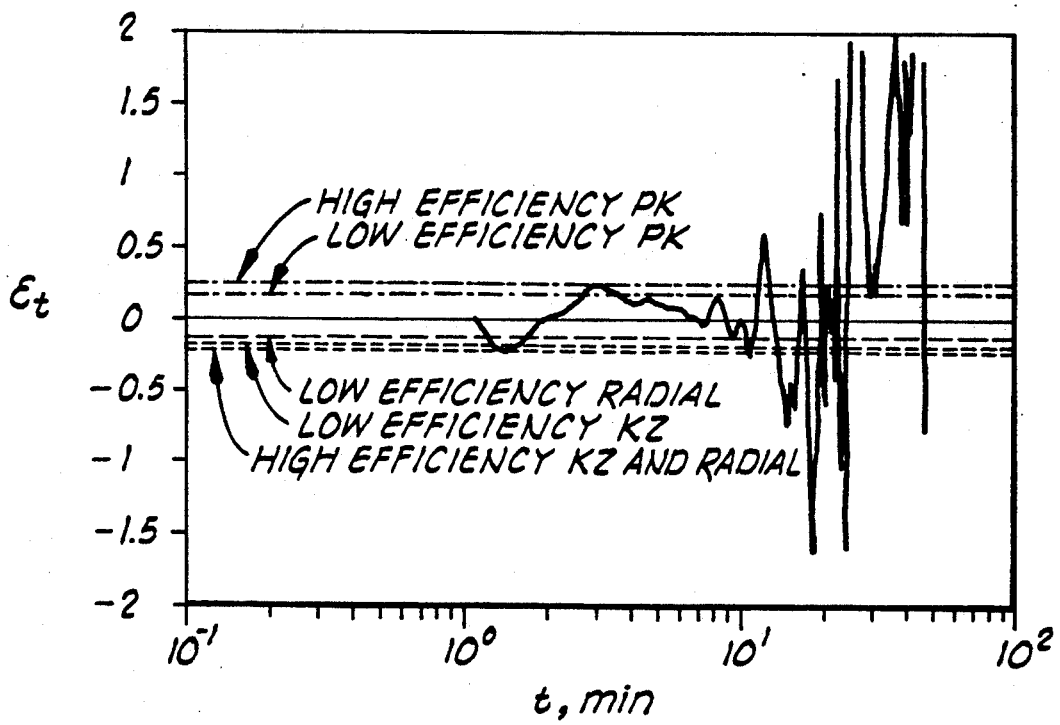
FIG. 12 shows the behavior of the slope of the log-log net pressure/injected time relationship as compared against log injection time for the San Andres fracture treatment example.

FIG. 9 displays the $\log(\Delta p)$-$\log(t)$ graph and FIG. 10 the $\log(\Delta p)$-$\log(V_i)$ graph. As can be seen from these two graphs, slopes are more shallow on the volume plot (FIG. 10), most especially in the early portion of the job when the rate is changing most dramatically. Although not very obvious on these graphs, it is slightly more noticeable on the slope graphs of FIGS. 11 and 12 that there is some moderation to the slopes in the near-constant rate portion of the treatment. The horizontal lines on FIGS. 11 and 12 represent, as in the FIGS. 5 and 6, the maximum and minimum slopes predicted by the various fracture models, but for n equal to 0.57.

The moderation in slope is brought out even more clearly in Table 2, which presents the results of a linear regression on the $\log(\Delta p)$-$\log(V_i)$ and $\log(\Delta p)$-$\log(t)$ data for the time span from 2 to 10 min of injection, during which no unusual pressure behavior was noted.

TABLE 2

| Time Interval (min) | Linear Regression Results For San Andres Example: Average Slope $\Delta p$ vs $V_i$ | Average Slope $\Delta p$ vs t | Coefficient Of Determination $\Delta p$ vs $V_i$ | Coefficient Of Determination $\Delta p$ vs t |
|---|---|---|---|---|
| 2.0–10.0 | 0.080 | 0.093 | 0.8958 | 0.8760 |

While the invention has been described with respect to the presently preferred embodiments, it will of course be appreciated by those skilled in the art that modifications or changes could be made to the invention without departing from its spirit or essential characteristics. Accordingly all modifications or changes which come within the meaning and range of equivalency of the claims are to be embraced within their scope.

What is claimed is:

1. A method of optimizing a fracturing treatment of a subsurface formation comprising the steps of:

(a) injecting a volume of fluid into a wellbore penetrating said subsurface formation to generate a fracture in said formation;

(b) measuring the pressure of the injected fluid in the wellbore over time;

(c) calculating the net pressure of the fluid in the wellbore over time;

(d) determining the volume of fluid injected into the wellbore over time;

(e) determining the slope of the logarithmic relationship between the net pressure of step (c) and the injected volume of step (d);

(f) modifying the fracture treatment based upon predetermined interpretive guidelines of the slope determined in step (e).

2. The method according to claim 1 wherein the wellbore pressure is measured adjacent to the fracture.

3. The method according to claim 1 wherein the volume of fluid injected into the wellbore is determined from the fluid pump rate over time.

4. The method according to claim 1 wherein the steps (e) and (f) are performed by a programmable real-time computer.

5. The method according to claim 1 wherein the step (e) is performed by a programmable real-time computer and comprising the further step of generating a distinct output from said computer when the slope determined in step (e) satisfies a predetermined condition of the predetermined interpretive guidelines.

6. The method according to claim 1 wherein the predetermined interpretive guidelines are based on a specific fracture model.

7. The method according to claim 1 wherein the fracture treatment is modified by discontinuing the injection of fluid into the wellbore.

8. The method according to claim 1 wherein the fracture treatment is modified by discontinuing the injection of proppant into the wellbore.

9. The method of claim 1 wherein the fracture treatment is modified by changing at least one member selected from the group of the rate of fluid injection and the injection pressure of the fluid whereby a new fracture treatment for the formation is designed.

10. A method of optimizing a fracturing treatment of a subterranean formation comprising the steps of:

(a) injecting a volume of fluid into a wellbore penetrating said subterranean formation to generate a fracture in said formation;

(d) determining the net pressure of the injected fluid in the wellbore over time;

(c) determining the volume of fluid injected into the wellbore over time;

(d) determining the slope of the logarithmic relationship between the net pressure of step (b) and the injected volume of step (c);

(e) determining he semi-logarithmic relationship between the slop of step (d) and the log of injected volume of step (c);

(f) modifying the fracture treatment based upon predetermined interpretive guidelines of the logarithmic relationship in step (e).

11. The method according to claim 10 wherein the wellbore pressure is measured adjacent to the fracture.

12. The method according to claim 10 wherein the volume of fluid injected into the wellbore is determined from the fluid pump rate over time.

13. The method according to claim 10 wherein the steps (d), (e) and (f) are performed by a programmable real-time computer.

14. The method according to claim 10 wherein the step (e) is performed by a programmable real-time computer and comprising the further step of generating a distinct output from said computer when the relationship determined in step (e) satisfies a predetermined condition of the predetermined interpretive guidelines.

15. The method according to claim 10 wherein the predetermined interpretive guidelines are based on a specific fracture model.

16. The method according to claim 10 wherein the fracture treatment is modified by discontinuing the injection of fluid into the wellbore.

17. The method according to claim 10 wherein the fracture treatment is modified by discontinuing the injection of proppant into the wellbore.

18. The method of claim 10 wherein the fluid is defined further as including a proppant and the fracture treatment is modified by changing at least one member selected from the group of the rate of fluid injection, the injection pressure of the fluid and the proppant concentration whereby a new fracture treatment for the formation is designed.

19. A method of optimizing the parameters of a fracturing treatment of a subterranean formation comprising the steps of:

(a) injecting a volume of fluid into a wellbore penetrating said subterranean formation to generate a fracture in said formation;

(b) measuring the pressure of the fluid in the wellbore over time;

(c) calculating the net pressure of the fluid in the wellbore over time;

(d) determining the volume of fluid injected into the wellbore over time;

(e) programming a real-time computer to determine the slope of the logarithmic relationship between the net pressure of step (c) and the injected volume of step (d);

(f) generating a computer signal when the slope of step (e) satisfies predetermined interpretive guidelines based upon a specific fracture model; and (g) modifying the fracture treatment based upon the signal generated in step (f).

20. The method of claim 19 wherein the fracture treatment is modified by changing at least one member selected from the group of the rate of fluid injection and the injection pressure of the fluid whereby a new fracture treatment for the formation is designed.

* * * * *

UNITED STATES PATENT AND TRADEMARK OFFICE

CERTIFICATE OF CORRECTION

PATENT NO. : 5,183,109

DATED : Feb. 2, 1993

INVENTOR(S) : Don K. Poulsen

It is certified that error appears in the above-identified patent and that said Letters Patent is hereby corrected as shown below:

On the cover page, item [21]:

Appl. No.: 781,523 should read as --
Appl. No.: 781,528 --

Signed and Sealed this

Ninth Day of November, 1993

*Attest:*

*Attesting Officer*

BRUCE LEHMAN

*Commissioner of Patents and Trademarks*